US007352380B2

(12) United States Patent
Takano et al.

(10) Patent No.: US 7,352,380 B2
(45) Date of Patent: Apr. 1, 2008

(54) THERMAL HEAD PRINTER AND PRINTING METHOD IN THERMAL HEAD PRINTER

(75) Inventors: Hiroaki Takano, Kanagawa (JP); Naoki Takizawa, Kanagawa (JP); Shinji Kato, Kanagawa (JP); Akihiro Horii, Miyagi (JP)

(73) Assignee: Sony Corporation, Tokyo (JP)

( * ) Notice: Subject to any disclaimer, the term of this patent is extended or adjusted under 35 U.S.C. 154(b) by 151 days.

(21) Appl. No.: 11/276,767

(22) Filed: Mar. 14, 2006

(65) Prior Publication Data

US 2006/0209160 A1 Sep. 21, 2006

(30) Foreign Application Priority Data

Mar. 16, 2005 (JP) ..... 2005-075733

(51) Int. Cl.
*B41J 2/36* (2006.01)

(52) U.S. Cl. ..... 347/194; 347/195

(58) Field of Classification Search ..... 347/188, 347/194–195; 400/120.09, 120.14, 120.15
See application file for complete search history.

(56) References Cited

U.S. PATENT DOCUMENTS 5,889,546 A 3/1999 Fukuoka
6,709,083 B2 * 3/2004 Fukushima ..... 347/17
2002/0113833 A1 8/2002 Fukushima

FOREIGN PATENT DOCUMENTS

EP 0 243 046 4/1987
EP 1 366 900 5/2002

OTHER PUBLICATIONS

European Search Report dated Mar. 8, 2007.

* cited by examiner

*Primary Examiner*—Huan Tran
(74) *Attorney, Agent, or Firm*—Sonnenschein Nath & Rosenthal LLP

(57) ABSTRACT

A thermal head printer includes a platen, a thermal head having a heating element, a heating-value arithmetic unit, a heating-value comparator, an excess-value counter, and a heating-value controller. The thermal head printer performs a printing operation by conveying a recording medium between the platen and the thermal head and heating the heating element on the basis of image data to be printed. The heating-value arithmetic unit calculates heating values for the heating element corresponding to the image data. The heating-value comparator compares each calculated heating value with a reference heating value of the heating element. The excess-value counter counts the number of calculated heating values that exceed the reference heating value so as to determine an excess-value number. The heating-value controller limits the heating values of the heating element if the excess-value number exceeds a reference number.

8 Claims, 8 Drawing Sheets

THERMAL HEAD PRINTER AND PRINTING METHOD IN THERMAL HEAD PRINTER

CROSS REFERENCES TO RELATED APPLICATIONS

The present invention contains subject matter related to Japanese Patent Application JP 2005-075733 filed in the Japanese Patent Office on Mar. 16, 2005, the entire contents of which are incorporated herein by reference.

BACKGROUND OF THE INVENTION

1. Field of the Invention

The present invention relates to thermal head printers and printing methods in thermal head printers for performing a printing operation by utilizing thermal energy generated in response to electricity applied to heating elements. In particular, the present invention relates to a thermal head printer and a printing method in a thermal head printer achieving both a higher print speed and longer lifespan.

2. Description of the Related Art

Known printing types of thermal head printers mainly include a dye-sublimation type, a thermal-wax type, and a thermal-recording type. These types of thermal head printers are provided with a line thermal head having a plurality of linearly-arranged heating elements (such as heating resistors) and electrodes. These heating resistors are selectively electrified in accordance with image data, by which thermal energy is generated. The thermal energy is utilized for performing a printing operation on various types of recording media, such as printing paper.

SUMMARY OF THE INVENTION

Accordingly, a thermal head performs a printing operation by heating the heating resistors in this manner. However, even when the printing operation is completed, if the heat generated for the printing operation remains stored in the thermal head and if the subsequent cooling process is insufficient, the printing paper may be subject to a so-called tailing phenomenon in which a tail-like mark is formed on the print face, or the printed image may be subject to, for example, an uneven density distribution.

Furthermore, in a thermal head printer, a printing operation is performed by pressing the thermal head over an ink ribbon against printing paper conveyed to a platen. Therefore, in order to protect the thermal head from, for example, abrasion caused by friction between the thermal head and the ink ribbon during printing, the heating resistors and the electrodes are coated with a protective film.

Since the thermal head has a certain thermal capacity, the heat generated by the heating resistors is transmitted to the ink ribbon with a certain time lag. Therefore, the actual temperature of each heating resistor is higher than a heating value (temperature) used for the actual printing.

Consequently, since the heat generated for the printing operation remains stored in the thermal head, if the subsequent cooling process is insufficient, the protective film may expand or may be subject to a change in its physical properties. This may cause the protective film to damage as a result of friction between the protective film and the ink ribbon. If the protective film is damaged to a large degree, the print face may be subject to scratches or it may be difficult to sufficiently transmit the heat generated by the heating resistors to the ink ribbon, thus resulting in a reduced print density.

Therefore, in order to solve these problems, such as a tailing phenomenon, an uneven density distribution, and damaging of the protective film, it is necessary to cool down the heated thermal head properly. On the other hand, in order to achieve high-speed printing, it is necessary to increase the instantaneous heating value per unit area of the thermal head. Recently, this has been achieved by increasing the thermal energy generated in the heating resistors. In this case, however, the heating values of the heating resistors are significantly problematic since the temperature of the thermal head is increased even more, which may further increase the risk of damaging of the protective film due to, for example, a change in its physical properties. Furthermore, increasing the print speed could also lead to abrasions in the thermal head (i.e. the protective film) and the ink ribbon.

A technique for increasing the print speed while solving problems, such as a tailing phenomenon, an uneven density distribution, and damaging of the protective film, is known. Specifically, this is achieved by lowering the peak temperature of the heating resistors. For example, Japanese Unexamined Patent Application Publication No. 63-295278 discloses a thermal head printer that controls the electricity applied to the heating resistors on the basis of print history so as to prevent heat from remaining in the thermal head.

According to Japanese Unexamined Patent Application Publication No. 63-295278, the time in which high voltage is applied to the heating resistors is shortened by performing both pulse-width control and voltage control on the basis of print history. Consequently, this enhances the durability of the heating resistors and provides a thermal head printer that allows for relatively high-speed printing.

However, the technique disclosed in Japanese Unexamined Patent Application Publication No. 63-295278 is limited in view of achieving further improvement of the print speed, and is thus difficult to meet the high-speed printing demands of recent years. Since the electricity applied to the heating resistors is controlled on the basis of past history in this technique, if the images to be printed and the images printed in the past differ greatly from each other, there may be cases where the print speed is undesirably reduced, or the lifespan of the protective film for the heating resistors becomes shorter than expected.

For example, an image taken in the daytime usually has a relatively low print density, whereas an image taken in the nighttime usually has a relatively high print density. If the print density is to be increased, the heating values of the heating resistors will be increased accordingly. This means that if the print history includes an image taken in the nighttime, the printing operation is performed at a low speed suitable for a nighttime image even if the image to be printed is a daytime image.

Likewise, if the print history includes an image taken in the daytime, the printing operation is performed at a speed for a daytime image even if the image to be printed is a nighttime image. Therefore, the heating values of the heating resistors are increased to correspond to the high print density, thus leading to a shorter lifespan of the protective film. On the other hand, to prepare for a nighttime image, the heating values of the heating resistors may be preliminarily reduced so as to prevent the lifespan of the protective film from being shortened. However, this means that the print speed will constantly be limited, and thus inhibits the improvement of the print speed.

Therefore, it is desirable to provide a thermal head printer and a printing method in a thermal head printer that prevent damaging of, for example, a protective film to achieve a longer lifespan of a thermal head, that solve problems, such as scratches on a print face, a reduced print density, a tailing phenomenon, and an uneven density distribution, and that achieve a significantly-enhanced print speed.

According to an embodiment of the present invention, there is provided a thermal head printer that performs a printing operation by conveying a recording medium between a platen and a thermal head and heating a heating element included in the thermal head on the basis of image data to be printed. The thermal head printer includes the platen, the thermal head having the heating element, a heating-value arithmetic unit, a heating-value comparator, an excess-value counter, and a heating-value controller. The heating-value arithmetic unit calculates heating values S for the heating element corresponding to the image data. The heating-value comparator compares each calculated heating value S with a reference heating value L of the heating element. The excess-value counter counts the number of calculated heating values S that exceed the reference heating value L on the basis of the comparison result of the heating-value comparator so as to determine an excess-value number N. The heating-value controller limits the heating values of the heating element if the excess-value number N exceeds a reference number M.

According to the above-referenced embodiment, the heating values for the heating element corresponding to the image data are preliminarily calculated.

Each of the calculated heating values S is then compared with the predetermined reference heating value L. If the number of calculated heating values S that exceed the reference heating value L (i.e. the excess-value number N) is greater than the reference number M, the heating values of the heating element are limited. Accordingly, the heating values of the heating element can be properly controlled in accordance with the image data to be printed, whereby the heating values of the heating element can be maintained within an optimal range.

For example, the reference heating value L of the heating element may be determined from theory and test results, and may be set to a value that prevents, for example, the protective film for the heating element from expanding. Furthermore, the reference number M used as a basis for the number of calculated heating values S that exceed the reference heating value L may be set in view of, for example, the degree of effect upon the protective film.

The heating-value arithmetic unit may have the capability to calculate heating values for all pixel data items included in the image data. In this case, each pixel data item corresponds to one pixel in the entire image. Alternatively, the heating-value arithmetic unit may sample the image data so as to calculate only the heating values that are necessary for printing sampled pixel data items included in the image data.

Furthermore, the heating values of the heating element are strongly related to gray-scale data (data related to density levels in an image) included in the image data and to a conveying speed of the recording medium. In detail, for printing out a dark image or for performing a printing operation at high speed, the heating values of the heating element are increased. Therefore, the heating-value arithmetic unit preferably calculates the heating values S of the heating element on the basis of the gray-scale data included in the image data and the conveying speed of the recording medium.

Furthermore, if the heating values of the heating element are limited while the conveying speed of the recording medium is kept at a high rate, the density of the printed image may possibly become lower. Therefore, the heating-value controller preferably limits the heating values of the heating element by reducing the conveying speed of the recording medium.

DESCRIPTION OF THE PREFERRED EMBODIMENTS

Embodiments of the present invention will now be described with reference to the drawings.

Figure 1:
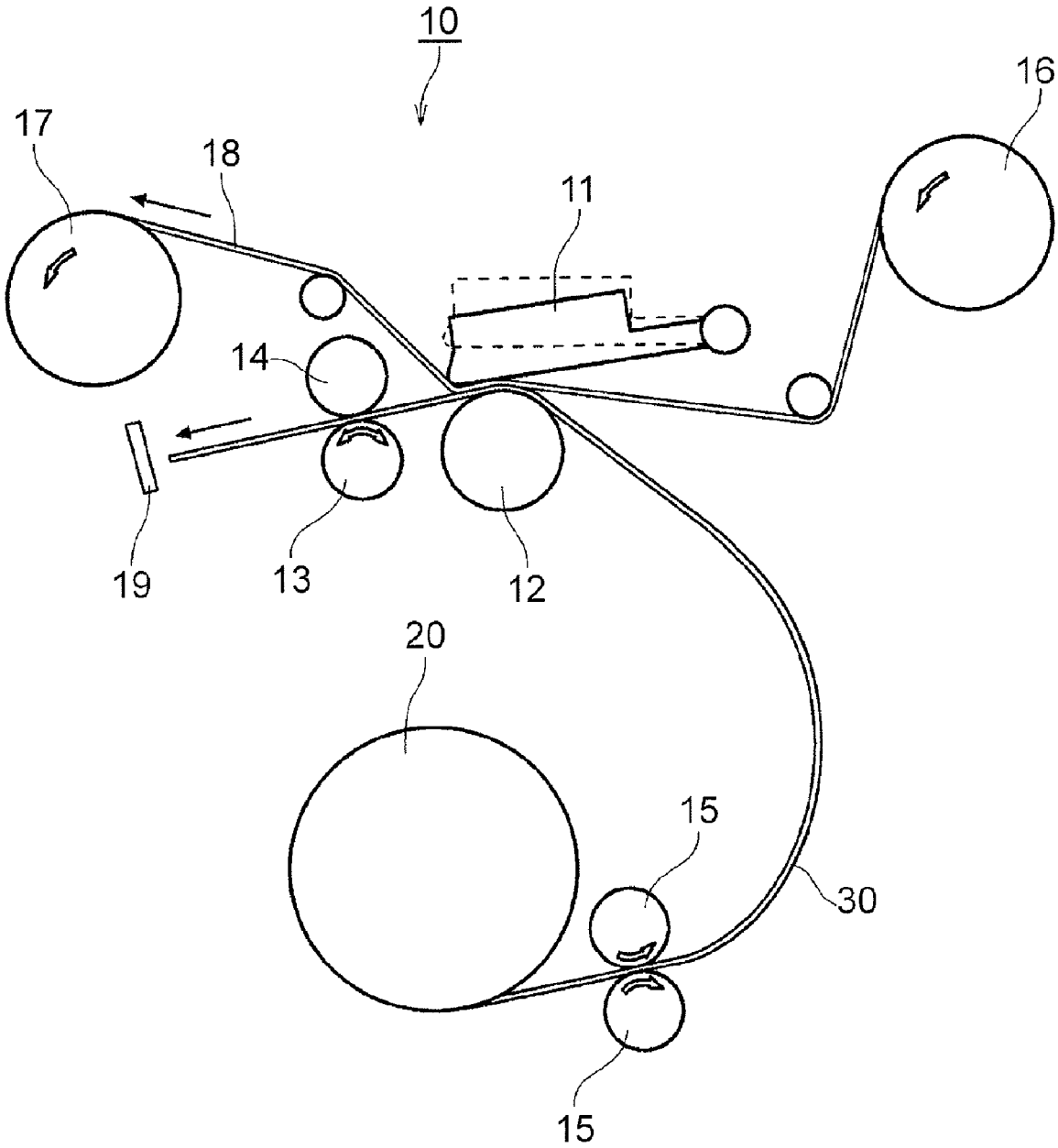
FIG. 1 is a side view showing a relevant portion of a thermal head printer according to an embodiment of the present invention.

FIG. 1 is a side view showing a relevant portion of a thermal head printer 10 according to an embodiment of the present invention.

Figure 2:
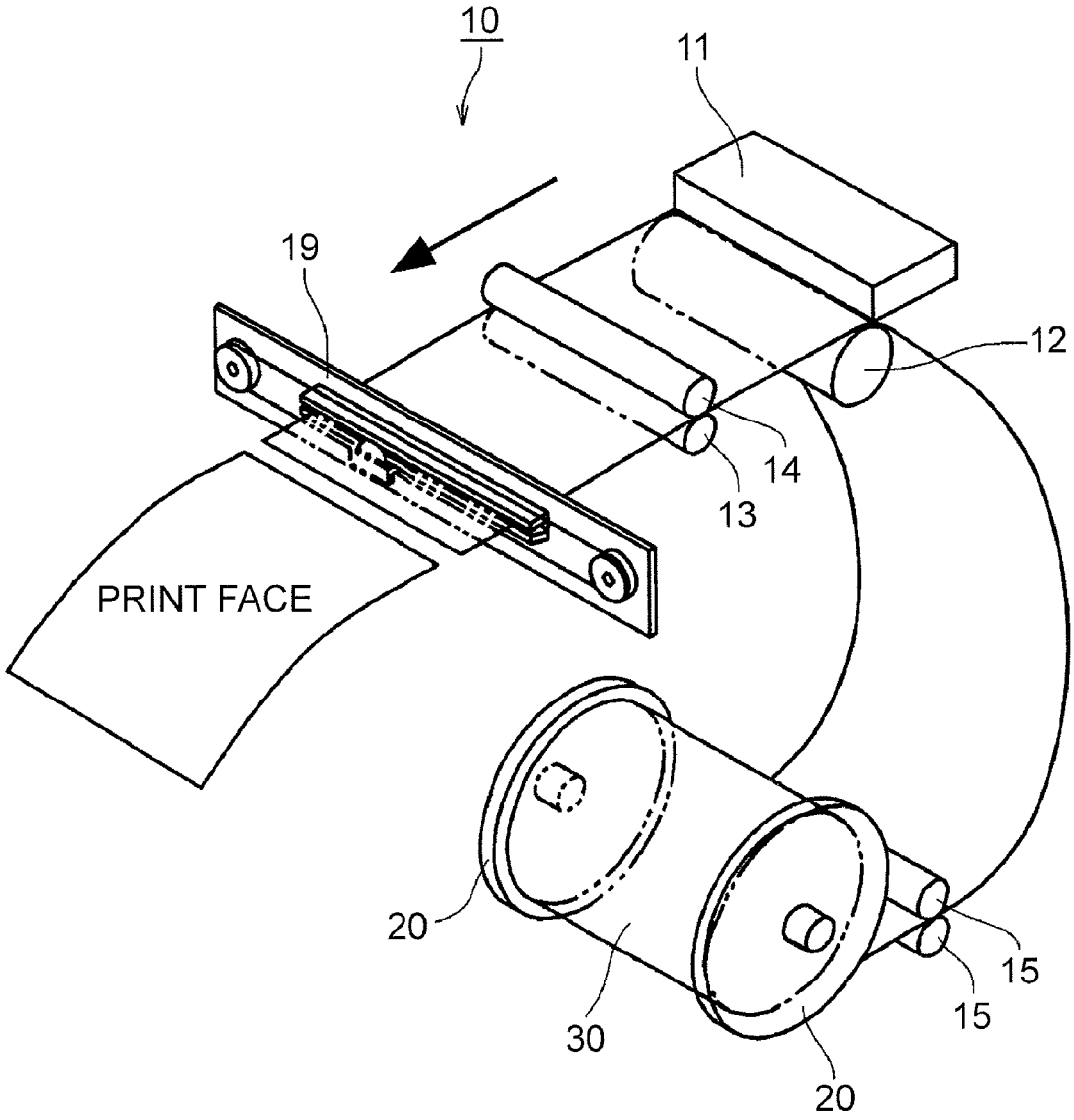
FIG. 2 is a perspective view showing a relevant portion of the thermal head printer according to the embodiment.

FIG. 2 is a perspective view showing a relevant portion of the thermal head printer 10 according to this embodiment. In FIG. 2, ink ribbons provided in the thermal head printer 10 are not shown.

The thermal head printer 10 shown in FIGS. 1 and 2 is provided with a dye-sublimation thermal head 11. Roll paper 30 serving as a recording medium is loadable in the thermal head printer 10. The thermal head 11 has a plurality of linearly-arranged heating resistors serving as heating elements. The thermal head printer 10 performs a printing operation by utilizing thermal energy generated in response to electricity applied to the heating resistors so as to transfer dry ink provided on an ink ribbon 18 shown in FIG. 1 onto the roll paper 30. If the thermal head 11 is an ink-transfer type, the printing operation is performed similarly by utilizing the thermal energy of the heating resistors to transfer the ink on the ink ribbon 18 onto the roll paper 30.

The thermal head printer 10 shown in FIGS. 1 and 2 is color-printable, such that the thermal head printer 10 is capable of loading three ink ribbons 18 respectively having three colors of dry ink, which are Y (yellow), M (magenta), and C (cyan). Furthermore, in addition to the three ink ribbons 18, the thermal head printer 10 may also be capable of loading a K (black) ink ribbon and an ink ribbon having an overcoat layer.

Referring to FIG. 1, in the thermal head printer 10, the ink ribbons 18 of colors corresponding to image data to be printed are unwound from a supply shaft 16 that rotates counterclockwise as indicated by an arrow. Each ink ribbon 18 extends between the thermal head 11 and a platen 12 and is taken up by a winding shaft 17.

On the other hand, referring to FIGS. 1 and 2, the roll paper 30 is held by a paper holder 20 disposed in the thermal head printer 10, and is unwound by a pair of unwinding rollers 15. The unwound roll paper 30 is set between the thermal head 11 and the platen 12. The roll paper 30 is then nipped between a capstan roller 13 and a pinch roller 14. The feeding of the roll paper 30 for a printing operation is implemented by rotating the capstan roller 13.

The printing operation performed by the thermal head printer 10 shown in FIGS. 1 and 2 will now be described.

In a non-printing mode, the thermal head 11 is raised as shown with a dotted line in FIG. 1, such that the thermal head 11 is slightly distant from the platen 12. Moreover, the roll paper 30 extending from the paper holder 20 is set on the platen 12, and the ink ribbons 18 are similarly set above the platen 12 and the roll paper 30.

When a print command is received, the previously-raised thermal head 11 is lowered to press against the platen 12. Thus, as shown in FIG. 1 with a solid line and in FIG. 2, the array of heating resistors of the thermal head 11 and the platen 12 nip the ink ribbons 18 and the roll paper 30. In other words, the heating resistors of the thermal head 11 apply pressure against the roll paper 30 via the ink ribbons 18 above the platen 12.

When image data is received in this state, the capstan roller 13 is rotated counterclockwise so that the roll paper 30 is conveyed sequentially in a direction indicated by a left pointing arrow. Furthermore, in response to a counterclockwise rotation of the winding shaft 17, the corresponding ink ribbon 18 is taken up sequentially at the same speed as the roll paper 30 in a direction of a left pointing arrow. Simultaneously, the heating resistors arranged on the thermal head 11 are selectively electrified in response to a drive control signal, whereby the thermal energy of the heating resistors is applied to the ink ribbon 18.

Subsequently, in accordance with heating values of the heating resistors of the thermal head 11, the dry ink on the ink ribbon 18 is transferred onto a print face of the roll paper 30, whereby a printing process is performed. The printed portion of the roll paper 30 is cut with a cutter 19 and is ejected through an ejection hole (not shown).

For a color-printing operation, the printing process is performed for each of the corresponding colors. This means that every time a color to be transferred is to be changed, the capstan roller 13 is rotated in the reverse direction so as to back-feed the roll paper 30 to a starting point for printing. In detail, when a printing process for a first color is completed, the thermal head 11 is raised to the position indicated with the dotted line in FIG. 1. The roll paper 30 is then back-fed to the starting point for printing so as to prepare for an over-printing process of a second color. Subsequently, the ink ribbon 18 having ink of the second color is conveyed from the supply shaft 16 so that a printing process for the second color is performed in the same manner as for the first color. When the printing process for each of the corresponding colors is completed, the roll paper 30 is cut with the cutter 19 and is ejected.

The thermal head printer 10 shown in FIGS. 1 and 2 performs a printing operation on the roll paper 30 in the above-described manner. Therefore, the print speed depends on the conveying speed of the roll paper 30, and moreover, the conveying speed of the roll paper 30 is affected by the heating values of the heating resistors of the thermal head 11. In other words, the print speed corresponds to a conveying speed of the roll paper 30 at which the maximum density level within gray-scale data (data related to density levels in an image) included in the image data can be printed using the thermal energy of the heating resistors. During a printing operation, the feeding of the roll paper 30 causes the heating resistors of the thermal head 11 and the ink ribbons 18 to repeatedly slide against each other.

Figure 3:
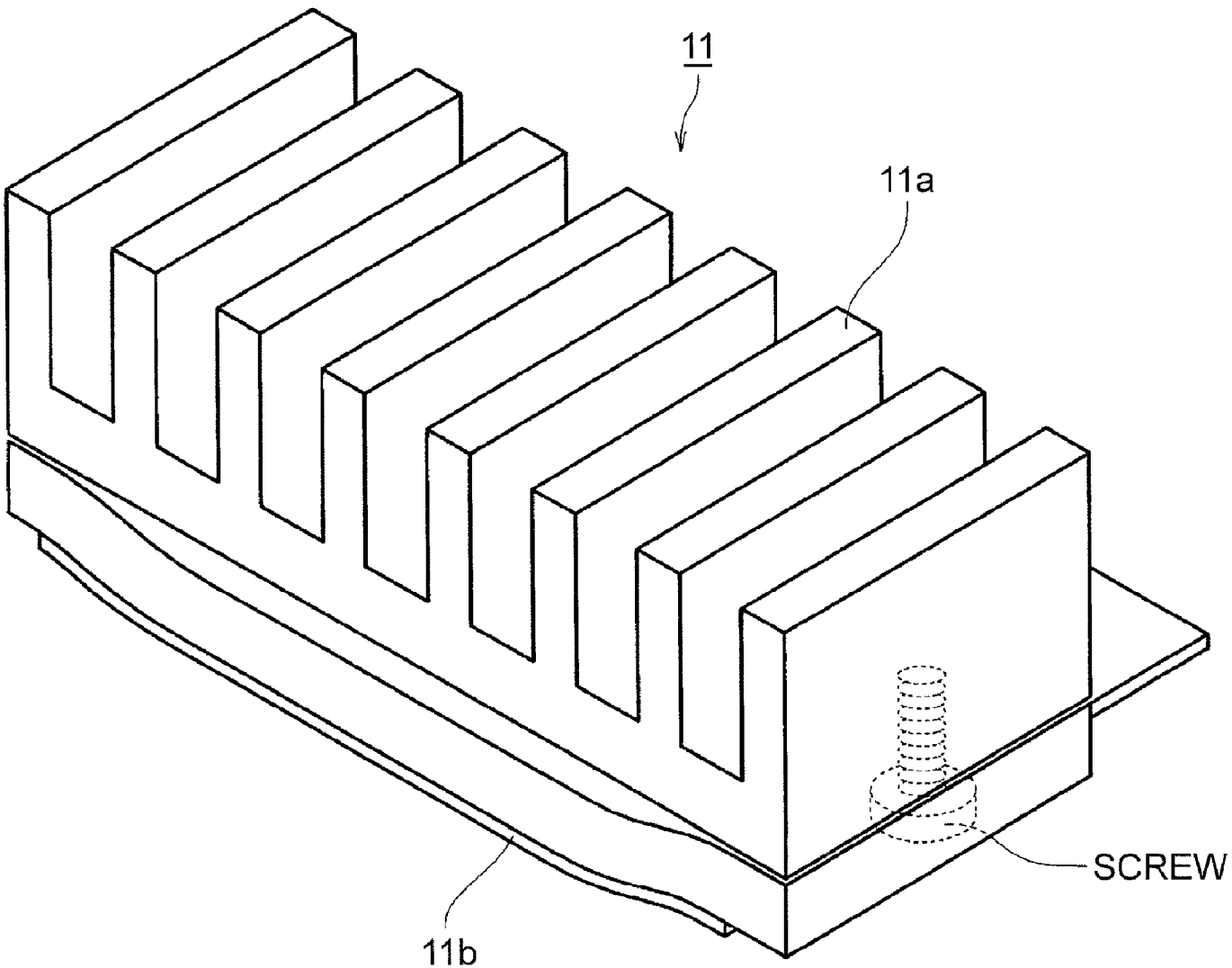
FIG. 3 is a perspective view of a thermal head included in the thermal head printer according to the embodiment.

FIG. 3 is a perspective view of the thermal head 11 included in the thermal head printer 10 according to this embodiment.

Figure 4:
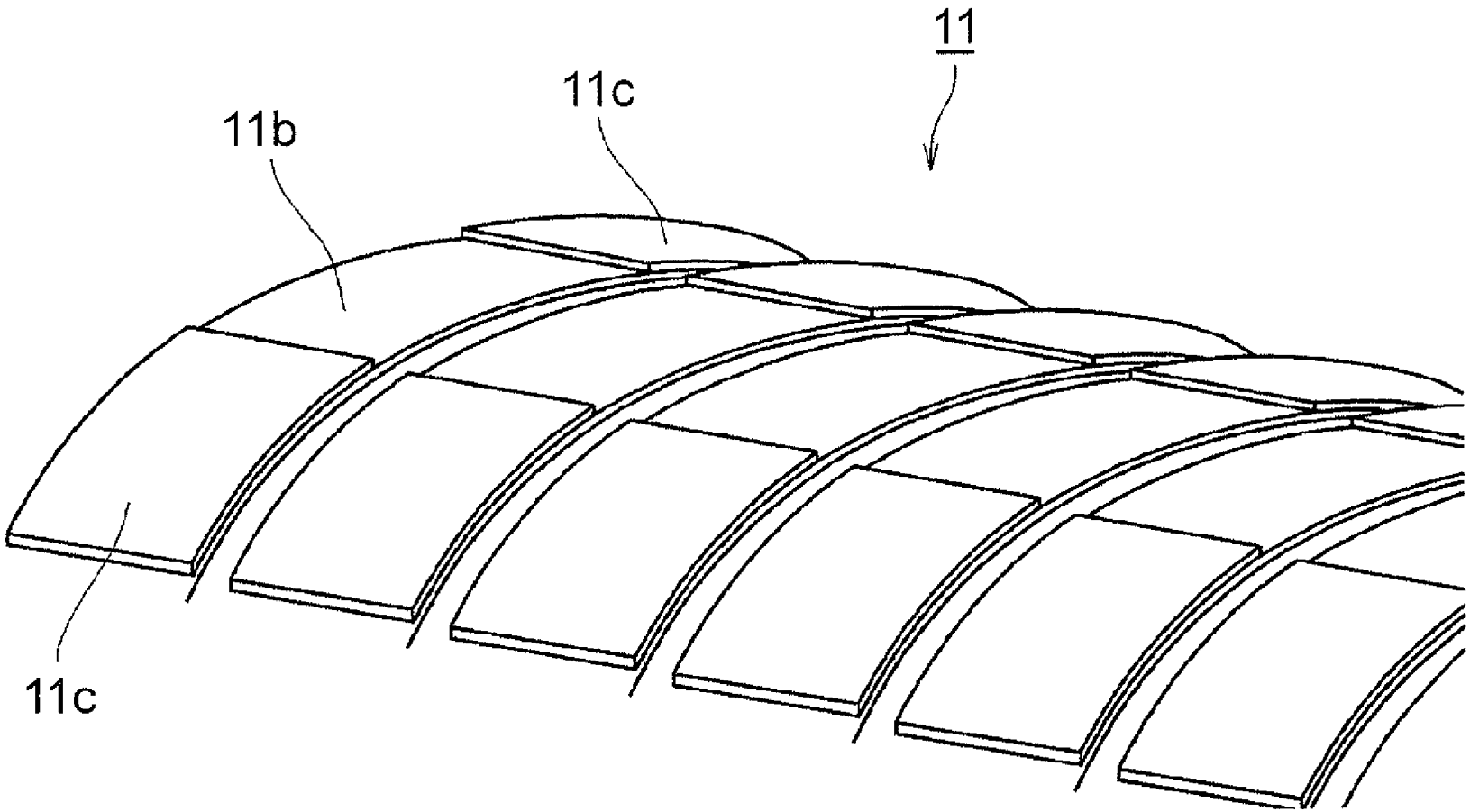
FIG. 4 is a perspective view partially illustrating the thermal head shown in FIG. 3, as viewed from a side of the thermal head provided with heating resistors.

Moreover, FIG. 4 is a perspective view partially illustrating the thermal head 11 shown in FIG. 3, as viewed from a side of the thermal head 11 provided with heating resistors 11*b*.

Referring to FIG. 3, the thermal head 11 has a heat sink 11*a* screwed on an upper surface thereof. The thermal head 11 also has a plurality of heating resistors 11*b* arranged on a lower surface thereof. The heat sink 11*a* is composed of a material having high heat conductivity, such as aluminum, and has a plurality of plate-like fins for releasing excess heat generated in the heating resistors 11*b*.

On the other hand, referring to FIG. 4, the heating resistors 11*b* are connected to electrodes 11*c*. As mentioned above, since the heating resistors 11*b* and the ink ribbons 18 repeatedly slide against each other during a printing operation (see FIG. 1), the heating resistors 11*b* and the electrodes 11*c* are coated with a protective film (not shown). Thus, the heating resistors 11*b* and the electrodes 11*c* are protected from abrasions.

When performing a printing operation using the thermal head 11 of this type, the electrodes 11*c* are electrified individually in accordance with image data so as to heat the heating resistors 11*b* corresponding to the electrified electrodes 11*c*. The heating values of the heating resistors 11*b* are controlled by adjusting the power applied to the electrodes 11*c* in accordance with gray-scale data in the image data.

Figure 5:
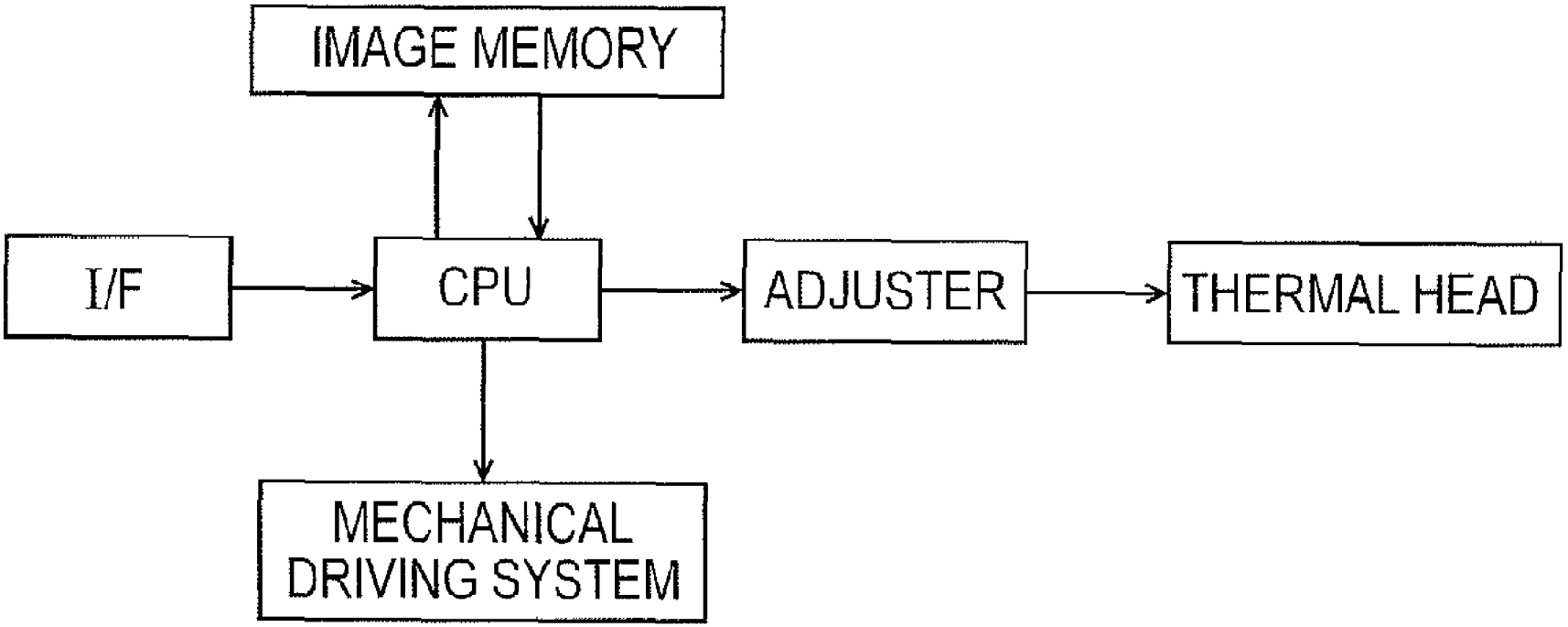
FIG. 5 is a block diagram illustrating a flow of a control operation performed in the thermal head printer according to the embodiment.

FIG. 5 is a block diagram illustrating a flow of a control operation performed in the thermal head printer 10 according to this embodiment.

Figure 6:
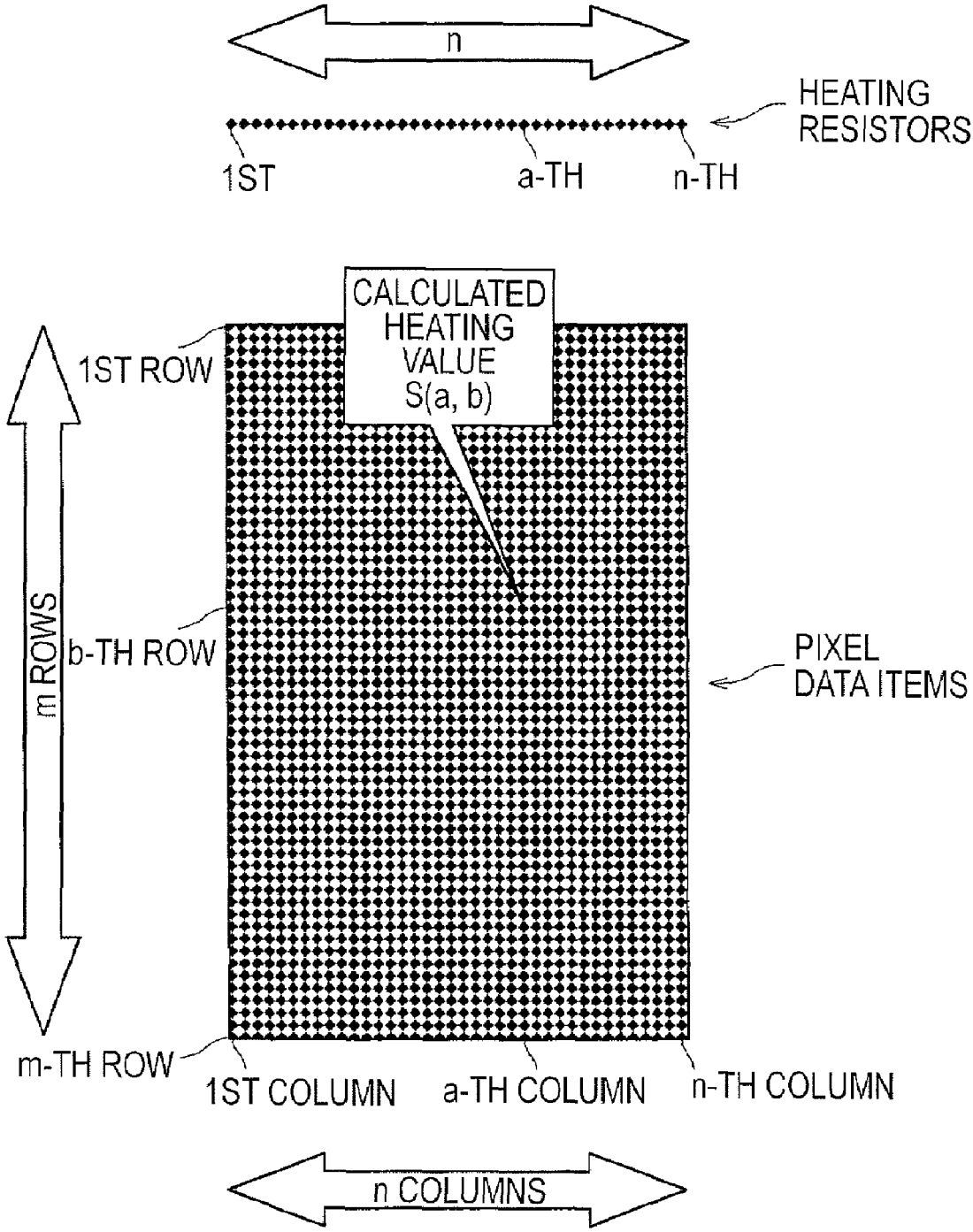
FIG. 6 schematically illustrates an example of image data sampled by the thermal head printer according to the embodiment.

FIG. 6 schematically illustrates an example of image data sampled by the thermal head printer 10 according to this embodiment.

Referring to FIG. 5, the thermal head printer 10 has an I/F (interface) through which image data is received from a computer. The received image data is stored in an image memory in accordance with a command of a CPU (central processing unit). The CPU functions as a heating-value arithmetic unit that calculates heating values for the heating resistors 11*b* of the thermal head 11 on the basis of the image data stored in the image memory. Thus, the CPU supplies the electrodes 11*c* with power to drive the heating resistors 11*b*.

Specifically, the CPU calculates heating values for the heating resistors 11*b* by sampling the image data. For example, FIG. 6 shows sampled pixel data items included in the image data and arranged in a matrix of m-rows by n-columns, in which each data item corresponds to one pixel in the entire image. Assuming that there are n heating resistors 11*b* such that "n" corresponds to the n-columns of pixel data items in a one-to-one fashion, the CPU calculates a preferred heating value S(a,b) for printing a pixel data item on a b-th row ($1 \leqq b \leqq m$) using an a-th heating resistor ($1 \leqq a \leqq n$) corresponding to an a-th column of the (m-row× n-column) pixel data items ($1 \leqq a \leqq n$). The heating values for the heating resistors 11*b* are determined in view of the gray-scale data in the image data and the conveying speed of the roll paper 30 (see FIG. 1).

Furthermore, the CPU also functions as a heating-value comparator, an excess-value counter, a maximum-excess-value-number extractor, and a heating-value controller. In detail, the heating-value comparator compares each calculated heating value S(a,b) for an a-th column and a b-th row with a preliminarily determined reference heating value L for the heating resistors 11*b*. The excess-value counter counts the number of calculated heating values S(a,b) that exceed the reference heating value L so as to determine an excess-value number N(a) for the a-th column. The maximum-excess-value-number extractor determines a maximum excess-value number N(max) on the basis of excess-value number N(1) to excess-value number N(n) for first to n-th columns. The heating-value controller controls the heating values of the heating resistors 11*b*. If the maximum excess-value number N(max) is greater than a predetermined reference number M, the CPU limits the heating values of the heating resistors 11*b* (i.e. the amount of power supplied to the electrodes 11*c*) within a predetermined range. The heating resistors 11*b* are thus driven in this manner so as to perform a printing operation.

Furthermore, referring to FIG. 5, each heating value of the heating resistors 11*b* is adjusted by an adjuster disposed between the CPU and the thermal head 11. Specifically, the adjuster adjusts a drive control signal output from the CPU in a manner such that the adjuster performs density adjustment (γ adjustment) on the print image and heat-storage adjustment in accordance with, for example, the quality of the roll paper 30 in the thermal head printer 10 (see FIG. 1), the type of ink ribbons 18 (see FIG. 1), the heated condition of the thermal head 11, and the ambient temperature.

Accordingly, the heating values of the heating resistors 11*b* of the thermal head 11 are optimized by the CPU and the adjuster. The CPU controls a mechanical driving system so that the roll paper 30 is conveyed at an optimal speed with respect to the heating values of the heating resistors 11*b*. Consequently, in the thermal head printer 10 according to this embodiment, various problems that may be induced by the heating of the heating resistors 11*b* are solved. For example, such problems include damaging of the protective film, scratches on the print face, a reduced print density, a tailing phenomenon, and an uneven density distribution. In addition to achieving a high print quality, the thermal head printer 10 also achieves a longer lifespan of the thermal head 11 and a higher print speed.

Figure 7:
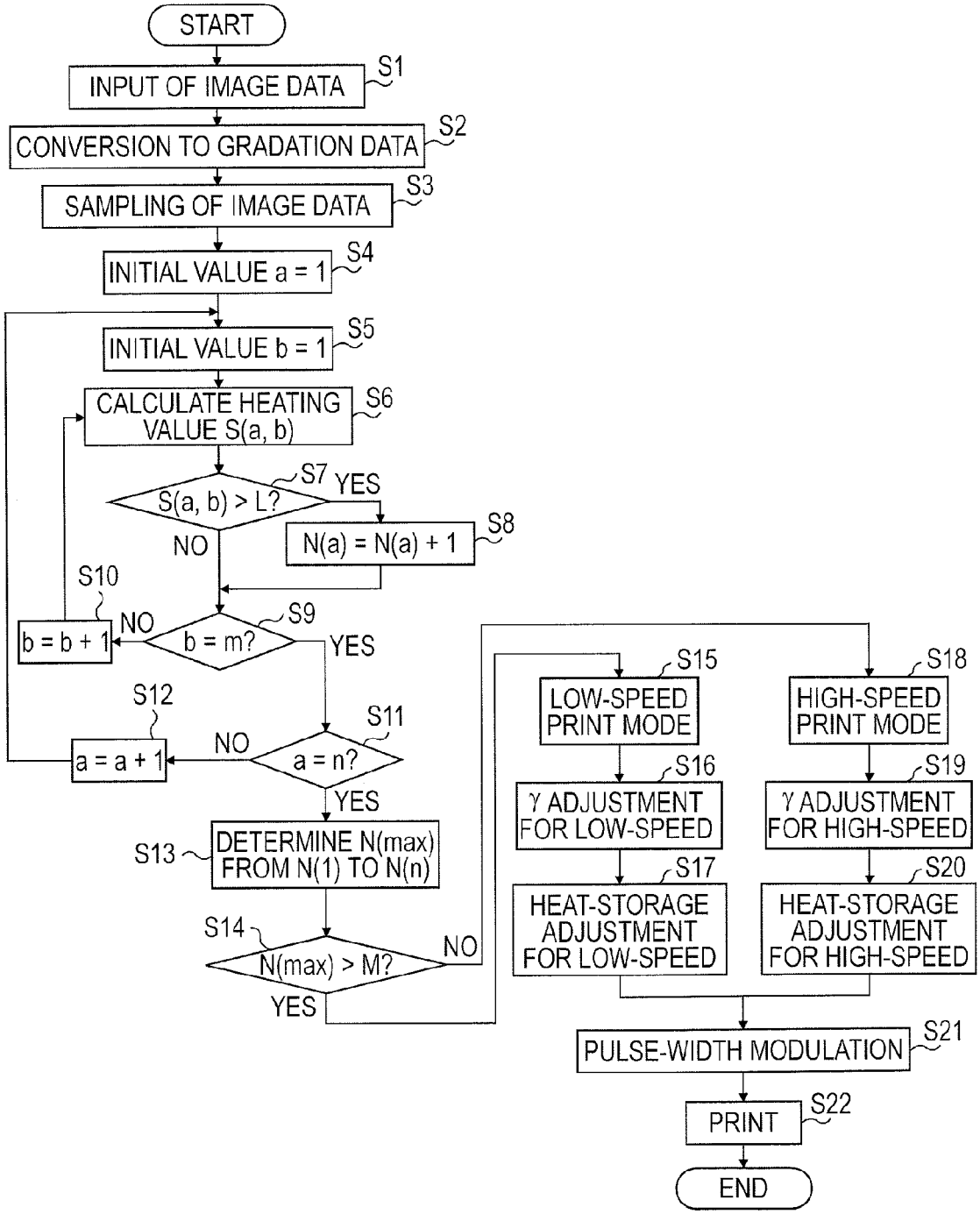
FIG. 7 is a flow chart illustrating a printing method in the thermal head printer according to an embodiment of the present invention.

FIG. 7 is a flow chart illustrating a printing method in the thermal head printer 10 according to an embodiment of the present invention.

Referring to FIG. 7, a printing operation starts in response to reception of a print command. In step S1, image data is received from a computer through the I/F shown in FIG. 5. The received image data is then stored in the image memory.

In step S2, the image data stored in the image memory is subject to color conversion. Specifically, the image data containing the three primary colors of light, which are R (red), G (green), and B (blue), is converted to gray-scale data containing the print colors Y (yellow), M (magenta), and C (cyan). In step S3, the (m-row×n-column) pixel data items shown in FIG. 6 are sampled on the basis of the gray-scale data, and are stored in the image memory.

In step S4, a=1 is input as an initial value, and in step S5, b=1 is input as an initial value. These initial values are for calculating a preferred heating value for printing a pixel data item on the first column (a=1) and first row (b=1) using the first heating resistor (a=1) of the n heating resistors 11*b*. In step S6, a calculated heating value S(a,b)=S(1,1) for the first column and first row is obtained. In step S7, the calculated value S(1,1) is compared with the reference heating value L. If S(1,1)>L, the operation proceeds to step S8 where a value 1 is added to the excess-value number N(a) having an initial value of 0 so that the excess-value number N(a)=N(1) for the first column (a=1) having the calculated value S(a,b) exceeding the reference heating value L is set to 1. The operation then proceeds to step S9. On the other hand, if S(1,1)≦L, the operation proceeds directly to step S9 from step S7.

The reference heating value L is determined from theory and test results, and is set to a value that prevents, for example, the protective film provided for the heating resistors 11*b* from expanding. In this embodiment, assuming that each print sheet is six inches long (that is, the printed roll paper is cut into 6-inch-long sheets), the reference heating value L is set such that, for example, even after printing on 3000 sheets, the protective film is prevented from being damaged, the print face is prevented from scratches, and the print density is prevented from being reduced. Moreover, the reference heating value L is also determined in view of the heat storability of the heating resistors and the effect of heat generated by the adjacent heating resistors.

Accordingly, it is determined in step S7 whether the calculated heating value S(a,b)=S(1,1) for printing the pixel data item on the first column (a=1) and first row (b=1) exceeds the reference heating value L. When the determination process for the first row is completed, the same steps are repeated for the second row onward. In step S9, it is determined whether the determination processes up to the last row, i.e. the m-th row, are completed. If the determination processes have not yet reached the m-th row (b=m), the operation proceeds to step S10 where a value 1 is added to "b" to perform a determination process for the subsequent row. The process from step S6 to step S9 is then repeated. After determining the excess-value number N(a)=N(1) up to the m-th row (b=m) of the first column (a=1), the operation proceeds to step S11 from step S9.

Step S11 is for determining the excess-value number N(a) from the second column (a=2) onward. In other words, after the excess-value number N(1) for the first column (a=1) is determined up to the m-th row (b=m), a preferred heating value for printing a pixel data item on the second column (a=2) and first row (b=1) using the second heating resistor (a=2) is calculated. Then, the excess-value number N(a)=N(2) up to the m-th row (b=m) of the second column (a=2) is determined. Subsequently, this is similarly performed until an excess-value number N(a)=N(n) is determined.

Accordingly, in step S11, it is determined whether the determination processes up to the last column, i.e. the n-th column (a=n), are completed. If the determination processes have not yet reached the n-th column, the operation proceeds to step S12 where a value 1 is added to "a" to perform determination processes for the subsequent column. Then, the process from step S5 to step S11 is repeated. After determining the excess-value number N(a)=N(n) up to the m-th row (b=m) of the n-th column (a=n), the operation proceeds to step S13 from step S11.

Consequently, based on the determined results of the excess-value number N(1) to the excess-value number N(n), the maximum excess-value number N(max) from the excess-value number N(1) to the excess-value number N(n) is determined in step S13. In step S14, it is determined whether the maximum excess-value number N(max) is greater than the predetermined reference number M.

In this case, the reference number M is set in view of, for example, the degree of effect of the excess-value number N(a) upon the protective film. In this embodiment, the reference number M is set to a numerical value corresponding to 30% of the m rows of the pixel data items arranged in a matrix of m-rows by n-columns, as shown in FIG. 6. In other words, M=0.3 m. From the first column (a=1) to the n-th column (a=n), it is determined whether there is at least one column in which the excess-value number N(a) exceeds 30% of the m rows.

Accordingly, it is determined whether the maximum excess-value number N(max) within the n columns exceeds the reference number M (=0.3 m). If the maximum excess-value number N(max) exceeds the reference number M, the heating values for the heating resistors 11*b* are limited so as to solve the various problems induced by heating, such as damaging of the protective film, scratches on the print face, a reduced print density, a tailing phenomenon, and an uneven density distribution. This contributes to a longer lifespan of the thermal head 11. In detail, the operation proceeds to step S15 from step S14 to switch to a low-speed print mode so as to prevent the print quality from being adversely affected even if the heating values are reduced. In step S16, density adjustment (γ adjustment) corresponding to the low-speed print mode is implemented. In step S17, heat-storage adjustment corresponding to the low-speed print mode is implemented. The operation then proceeds to step S21.

In contrast, if the maximum excess-value number N(max) does not exceed the reference number M (=0.3 m), high-speed printing can be performed with the heating values of the heating resistors being set at the maximum. Accordingly, the operation proceeds from step S14 to step S18 to switch to a high-speed print mode. In step S19, density adjustment (γ adjustment) corresponding to the high-speed print mode is implemented. In step S20, heat-storage adjustment corresponding to the high-speed print mode is implemented. The operation then proceeds to step S21.

According to the printing method in this embodiment, a low-speed print mode or a high-speed print mode is selected in accordance with the input image data. Upon completion of the desired heat-storage adjustment, the operation proceeds to step S21 where pulse-width modulation, for example, is performed. In step S22, power is supplied to the electrodes to drive the heating resistors so that a printing process is performed. This completes the printing operation.

Figure 8:
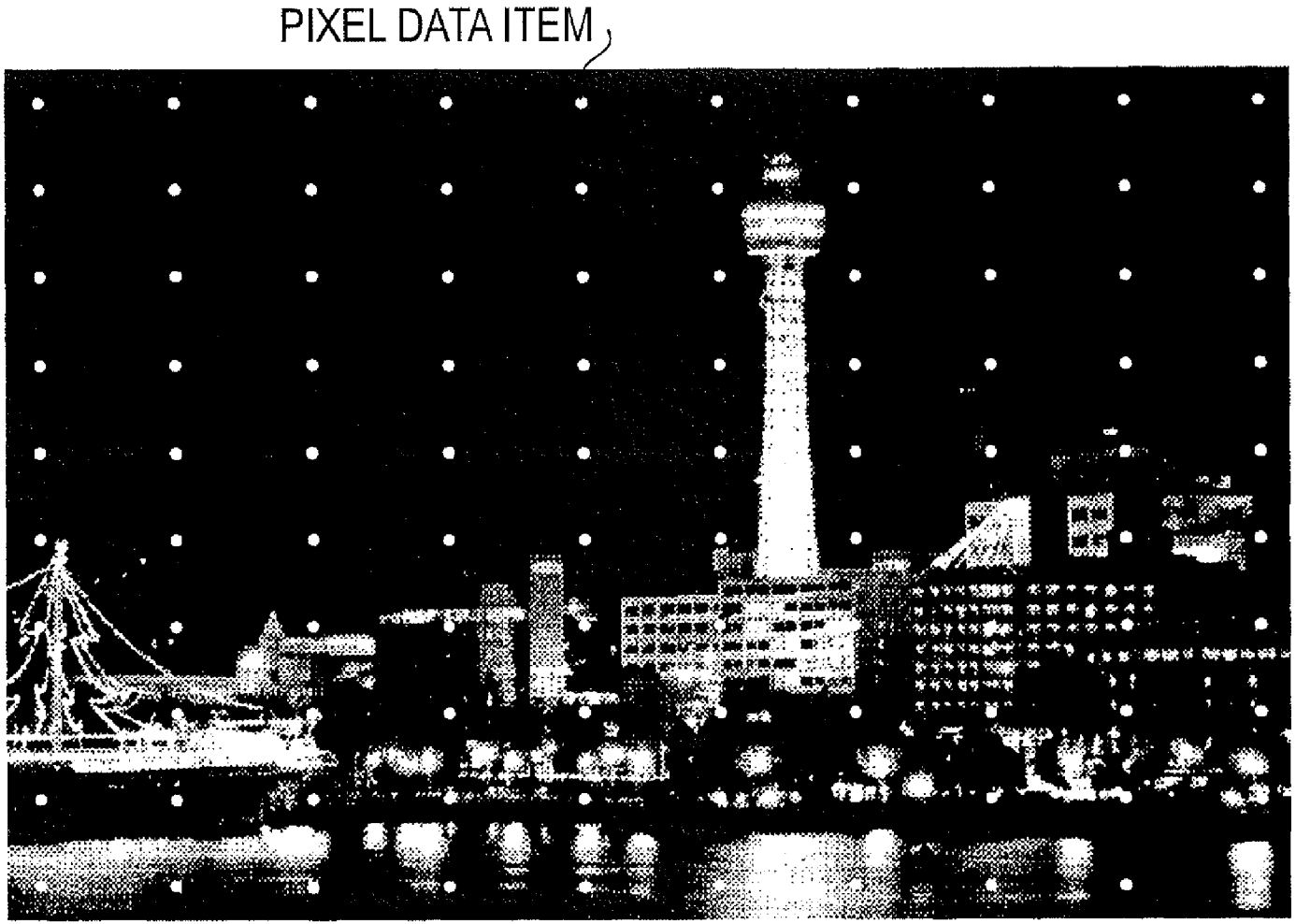
FIG. 8 illustrates an example of an image printed by the thermal head printer according to the embodiment.

FIG. 8 illustrates an example of an image printed by the thermal head printer 10 according to the embodiment of the present invention. For an illustrative purpose, sampled (10-row×10-column) pixel data items are indicated with white dots. Furthermore, this image is a monochrome binary image converted from a color image.

Unlike the example shown in FIG. 6 in which heating values S(a,b) for all pixel data items corresponding to the heating resistors 11*b* are calculated, the image shown in FIG. 8 is printed by calculating heating values S(a,b) only for the (10-row×10-column) pixel data items corresponding to heating resistors that are disposed at every predetermined interval. In this case, n=10 and m=10 in FIG. 7, such that the process from step S6 to step S9 and the process from step S5 to step S11 are performed only 10 times, thereby allowing high-speed processing. Moreover, this also allows for the use of a low-performance CPU. It is determined whether or not the maximum excess-value number N(max) within the 10 columns exceeds the reference number M (=30% of 10 rows=3). Furthermore, processes other than the actual printing do not necessarily have to be implemented in the printer, and may alternatively be implemented in a printer driver contained in a computer.

When the number of sampled data items is reduced as in this example, even though the processing time of the image data is shortened and the print speed can be further increased, the maximum excess-value number N(max) may vary depending on differences in the sampling locations. This implies that the reference number M is desirably set with great attention. Based on an analysis of images taken with various digital cameras for finding the proper setting of the reference number M, it was discovered that there are not many images with a maximum excess-value number N(max) that exceeds 30% of m rows of sampled (m-row×n-column) pixel data items. Accordingly, setting the reference number M to 0.3 m is appropriate. Therefore, even for (10-row×10-column) pixel data items, setting the reference number M to 3 allows for a higher print speed for various types of image data.

However, because the image shown in FIG. 8 is taken at night, a large portion of the image has a high density, which implies that the maximum excess-value number N(max)> the reference number M. Therefore, for printing the image shown in FIG. 8, the print speed is set lower than in a case where the maximum excess-value number N(max)≦ the reference number M in order to contribute to a longer lifespan of the thermal head 11. Specifically, the print speed is reduced to 1.0 sec/line so that the printing time is slower by 1.4 times. The reason for reducing the print speed is that the print density per unit area is strongly related to the amount of heat per unit time and the time period in which heat is applied. Therefore, by increasing the time per unit area, the heating values can be reduced.

In the thermal head printer 10 and the printing method in the thermal head printer 10 according to the embodiments of the present invention, the heating values for the heating resistors 11*b* are preliminarily calculated on the basis of the input image data so as to determine how much the heat generated by the heating resistors 11*b* could possibly damage, for example, the protective film. In other words, the maximum excess-value number N(max) and the reference number M of the heating values of the heating resistors 11*b* are compared so as to control the heating values (print speed). Accordingly, this reduces the risk of, for example, damaging the thermal head 11 (the protective film), thereby extending the lifespan thereof under high-speed printing.

The technical scope of the present invention is not limited to the above embodiments, and modifications are permissible within the scope and spirit of the present invention.

For example, although the thermal head printer 10 according to the above embodiment prints an image on the roll paper 30 with the ink ribbons 18, the roll paper 30 may alternatively be replaced with a cut sheet of paper.

Furthermore, the same advantage as described above can be achieved in a case where the thermal head printer 10 prints an image on thermal recording paper without using the ink ribbons 18.

Furthermore, although the thermal head printer 10 according to the above embodiment switches between two modes, which are a low-speed print mode and a high-speed print mode, additional print modes, such as a medium-speed print mode, may also be provided so that the control operation can be implemented in a more finely manner. In that case, a plurality of reference numbers M may be set in accordance with the number of print modes. For example, the reference numbers M may include a reference number M(1) corresponding to the low-speed print mode and a reference number M(2) corresponding to the medium-speed print mode.

In the thermal head printer 10 and the printing method in the thermal head printer 10 according to the above embodiments, since the image data to be printed is sampled and the heating values for the heating resistors 11*b* are preliminarily calculated so as to control the heating values, a longer lifespan and high-speed printing can both be achieved. Therefore, the thermal head printer 10 is applicable to a wide variety of purposes.

It should be understood by those skilled in the art that various modifications, combinations, sub-combinations and alterations may occur depending on design requirements and other factors insofar as they are within the scope of the appended claims or the equivalents thereof.

What is claimed is:

1. A thermal head printer performing a printing operation by conveying a recording medium between a platen and a thermal head and heating a heating element included in the thermal head on the basis of image data to be printed, the thermal head printer comprising:

the platen;

the thermal head having the heating element;

a heating-value arithmetic unit that calculates heating values S for the heating element corresponding to the image data;

a heating-value comparator that compares each calculated heating value S with a reference heating value L of the heating element;

an excess-value counter counts the number of calculated heating values S that exceed the reference heating value L on the basis of the comparison result of the heating-value comparator so as to determine an excess-value number N; and a heating-value controller that limits the heating values of the heating element if the excess-value number N exceeds a reference number M.

2. The thermal head printer according to claim 1, wherein the heating-value arithmetic unit samples the image data to calculate the heating values S of the heating element for printing sampled pixel data items included in the image data.

3. The thermal head printer according to claim 1, wherein the heating-value arithmetic unit calculates the heating values S of the heating element on the basis of gray-scale data included in the image data and a conveying speed of the recording medium.

4. The thermal head printer according to claim 1, wherein the heating-value controller limits the heating values of the heating element by reducing a conveying speed of the recording medium.

5. A line thermal head printer performing a printing operation by conveying a recording medium between a platen and a thermal head and heating a plurality of heating elements included in the thermal head on the basis of image data to be printed, the line thermal head printer comprising:

the platen;

the thermal head having the plurality of heating elements linearly arranged therein;

a heating-value arithmetic unit that calculates heating values S(a,b) for printing pixel data items included in the image data and arranged in a matrix of in-rows by n-columns, each pixel data item disposed on a b-th row ($1 \leqq b \leqq m$) to be printed using one of the heating elements that corresponds to an a-th column ($1 \leqq a \leqq n$) of the pixel data items;

a heating-value comparator that compares each calculated heating value S(a,b) for the a-th column and the b-th row with a reference heating value L of the heating elements;

an excess-value counter that counts the number of calculated heating values S(a,b) that exceed the reference heating value L on the basis of the comparison result of the heating-value comparator so as to determine an excess-value number N(a) for the a-th column;

a maximum-excess-value-number extractor that determines a maximum excess-value number N(max) on the basis of excess-value number N(1) to excess-value number N(n) for first to n-th columns determined by the excess-value counter; and a heating-value controller that limits the heating values of the heating elements if the maximum excess-value number N(max) exceeds a reference number M.

6. A printing method in a thermal head printer that performs a printing operation by conveying a recording medium between a platen and a thermal head and heating a heating element included in the thermal head on the basis of image data to be printed, the method comprising the steps of:

calculating heating values S for the heating element corresponding to the image data;

comparing each calculated heating value S with a reference heating value L of the heating element;

counting the number of calculated heating values S that exceed the reference heating value L so as to determine an excess-value number N; and limiting the heating values of the heating element if the excess-value number N exceeds a reference number M.

7. The printing method according to claim 6, wherein a conveying speed of the recording medium is reduced if the excess-value number N exceeds the reference number M.

8. A printing method in a line thermal head printer that performs a printing operation by conveying a recording medium between a platen and a thermal head and heating a plurality of heating elements linearly arranged in the thermal head on the basis of image data to be printed, the method comprising the steps of:

calculating heating values S(a,b) for printing pixel data items included in the image data and arranged in a matrix of in-rows by n-columns, each pixel data item disposed on a b-th row ($1 \leqq b \leqq m$) to be printed using one of the heating elements that corresponds to an a-th column ($1 \leqq b \leqq n$) of the pixel data items;

comparing each calculated heating value S(a,b) for the a-th column and the b-th row with a reference heating value L of the heating elements;

counting the number of calculated heating values S(a,b) that exceed the reference heating value L so as to determine an excess-value number N(a) for the a-th column;

determining a maximum excess-value number N(max) on the basis of excess-value number N(1) to excess-value number N(n) for first to n-th columns; and limiting the heating values of the heating elements if the maximum excess-value number N(max) exceeds a reference number M.

* * * * *